US007124524B2

(12) United States Patent
Valenti, Jr.

(10) Patent No.: US 7,124,524 B2
(45) Date of Patent: Oct. 24, 2006

(54) TAG WITH FOLDING REINFORCEMENT

(75) Inventor: F. Paul Valenti, Jr., Barrington, IL (US)

(73) Assignee: Chicago Tag & Label, Inc., Libertyville, IL (US)

( * ) Notice: Subject to any disclaimer, the term of this patent is extended or adjusted under 35 U.S.C. 154(b) by 0 days.

(21) Appl. No.: 10/273,391

(22) Filed: Oct. 17, 2002

(65) Prior Publication Data

US 2004/0074116 A1 Apr. 22, 2004

(51) Int. Cl.
*G09F 3/02* (2006.01)

(52) U.S. Cl. ..... 40/27; 40/638

(58) Field of Classification Search ..... 40/27, 40/299, 638; 229/92, 92.8, 300; 428/40.1, 428/43; 206/460; 244/153 R; 292/307 R
See application file for complete search history.

(56) References Cited

U.S. PATENT DOCUMENTS

| | | | | |
|---|---|---|---|---|
| 338,685 | A * | 3/1886 | Morrell | 40/27 |
| 1,717,443 | A * | 6/1929 | Flood | 40/27 |
| 2,346,219 | A * | 4/1944 | Johnson | 40/638 |
| 2,471,145 | A * | 5/1949 | Erickson | 40/27 |
| 2,545,505 | A * | 3/1951 | Wall | 40/27 |
| 3,334,736 | A * | 8/1967 | Mac et al. | 206/460 |
| 4,446,183 | A | 5/1984 | Savagian | 428/42 |
| 4,871,133 | A * | 10/1989 | Alonso | 244/153 R |
| 5,236,766 | A * | 8/1993 | Cole | 40/27 |
| 5,373,656 | A | 12/1994 | Merser | 40/663 |
| 5,546,688 | A | 8/1996 | Merser | 40/663 |
| 5,573,825 | A * | 11/1996 | Brewster | 428/43 |
| 5,582,433 | A * | 12/1996 | Sisson | 283/81 |
| 5,664,725 | A * | 9/1997 | Walz | 229/92 |
| 5,721,178 | A * | 2/1998 | Lalande | 428/40.1 |
| 5,984,388 | A * | 11/1999 | Bacon | 292/307 R |
| 6,403,184 | B1 * | 6/2002 | Michlin | 428/40.1 |
| 6,415,976 | B1 | 7/2002 | Flynn et al. | 229/71 |

* cited by examiner

*Primary Examiner*—Lars A. Olson
(74) *Attorney, Agent, or Firm*—Ice Miller LLP

(57) ABSTRACT

A tag having a reinforcible opening is disclosed. The tag includes first and second major surfaces. It further includes an adhesive layer affixed to one of the major surfaces and substantially covered by a removable liner material. The tag has two openings arranged such that when the liner material is removed and the tag is folded along a fold line the adhesive bonds the tag into a folded position wherein the openings are aligned to form a single continuous opening through the tag.

20 Claims, 17 Drawing Sheets

30

60

65

TAG WITH FOLDING REINFORCEMENT

FIELD OF THE INVENTION

The present invention relates to printable tags, more specifically, it relates to a printable tag having a folding portion which provides reinforcement to a tag opening.

DESCRIPTION OF THE RELATED ART

Tags are a widely used device for identifying an object by attaching the tag to the object using a string or other fastening member. A tag generally includes a printable portion which has information printed on it, and a hole through which the fastening member is threaded to allow the tag to be securely fastened to an object. Tags have been used in numerous applications, and continue to provide a low cost, easy to use solution for persons desiring a means for identifying and organizing objects.

One problem with prior art tags is that the hole has a tendency to tear during use. In order to cure this problem, reinforced tags have been developed wherein a reinforcing material is placed around the hole to prevent tearing.

The manufacturing of tags having reinforced holes is generally a multi-step process which typically includes the steps of printing the tag, making a hole in the tag, reinforcing the hole, and trimming the tag to the proper size. While tags may be manufactured using a sheet press, they are predominantly manufactured on web presses which allow for a web of feed stock to be transformed into the final product of individual tags by undergoing these processes.

Typically, the web is printed in one part of the press, a hole punched and reinforced in another part of the press, and the tag die cut to the desired shape in another portion of the press. Of these steps, the step which generally most limits the manufacturing speed, and the materials which may be used, is the punching and reinforcing of the hole, as this is generally done using a reciprocating press which simultaneously punches a hole through the tag, and puts down a reinforcing patch around the hole. Even though placing a reinforcing material on the tag slows down the overall rate of manufacture, it remains a necessary step for making high performance tags which do not easily tear when they are attached to an object using a fastening member threaded through the hole.

The reciprocating press for punching and reinforcing the hole generally includes a male and female portion which together close unto the tag surface. In between the tag and the press is the reinforcing material. The reinforcing material is generally a web of material unto which is coated an adhesive. The press cuts out a section of reinforcing material and adheres it securely to the tag, while a punch simultaneously makes a hole in the both the tag and the reinforcing patch near to the center of the patch. This method is used to manufacture the well known "donut" reinforcement on prior art tags. This method may be used to simultaneously adhere reinforcing patches to both the top and bottom surfaces of the tag if additional strength is required.

Tags manufactured according to this method have certain drawbacks. One drawback, as discussed above, is the relatively slow rate of manufacture of the tags which is limited in that the web of material must come to a stop while the hole is punched and the reinforcing material applied. Another drawback is in the materials which may be used. Typically, material used in manufacturing tags having reinforcing patches is paper. The press described above does not operate well when certain materials, including synthetic materials having relatively high strength and flexibility, are used. In particular, when paper is used for the patch material it may be easily punched through. However, when a synthetic material is used, the dies may have greater difficulty cleanly punching holes through the patches. Also, the use of a male and female type die makes it expensive to apply reinforcing patches of different shapes due to the cost of procuring different shaped dies.

Another problem with the prior art tags is that they cannot be easily used in conjunction with a computer driven printer by an end user to customize the tags by applying printed indicia. The materials used in prior art tags is often a thick paper material used to impart the desired strength to the tag. Prior art tags are difficult to print using computer driven printers due to the thickness of the tags, and in particular, the thickness of the reinforced portion of the tags.

These problems and others have been addressed to create the tags which forms the subject of the present invention.

BRIEF SUMMARY OF THE INVENTION

A first aspect of the present invention provides a tag having a reinforcible opening including first and second major surfaces. An adhesive layer is affixed to one of the major surfaces, and is substantially covered by a removable liner material. The tag has two openings arranged such that when the liner material is removed and the tag is folded along a fold line, the adhesive bonds the tag into a folded position. In the folded position the openings are aligned to form a single continuous opening through the tag.

According to another aspect of the present invention, a tag having a reinforcible opening includes first and second major surfaces. A first adhesive layer is affixed to one of the first or second surfaces and has a liner material removably bonded to it. The tag includes two openings which are located equidistance from a fold line which divides the tag into a first portion and a second portion. When the liner material is removed from the adhesive layer and the tag is folded along the fold line into a folded position, the first portion and the second portion become bonded together. In the folded position the two openings are aligned and create a single opening through the folded tag.

According to another aspect of the present invention, a tag having a reinforcible opening includes a tag material having a first and second major surface. A reinforcing material is bonded to and covers an extent of a major surface. A fold line in the tag divides the tag into a first and second portion. An adhesive is arranged to bond the first portion to the second portion. A liner material is removably bonded to the adhesive. Holes are formed through the tag material and reinforcing material such that when the liner material is removed from the adhesive layer and the tag is folded along the fold line, the first portion and the second portion become bonded together such that the two holes are aligned and create a single reinforced hole through the folded tag.

According to another aspect of the present invention, a continuous feed multi-tag form for use in a computer driven printer includes a plurality of operably connected tags. Each individual tag includes a reinforcing region having a fold line positioned between two openings such that when the tag is placed in a folded position by folding the tag along the fold line, the two openings become aligned such that they form a continuous opening through the tag. Each tag further includes an adhesive arranged to bond the tag into the folded position when a removable release liner material is removed.

DETAILED DESCRIPTION OF THE INVENTION

Figure 1:
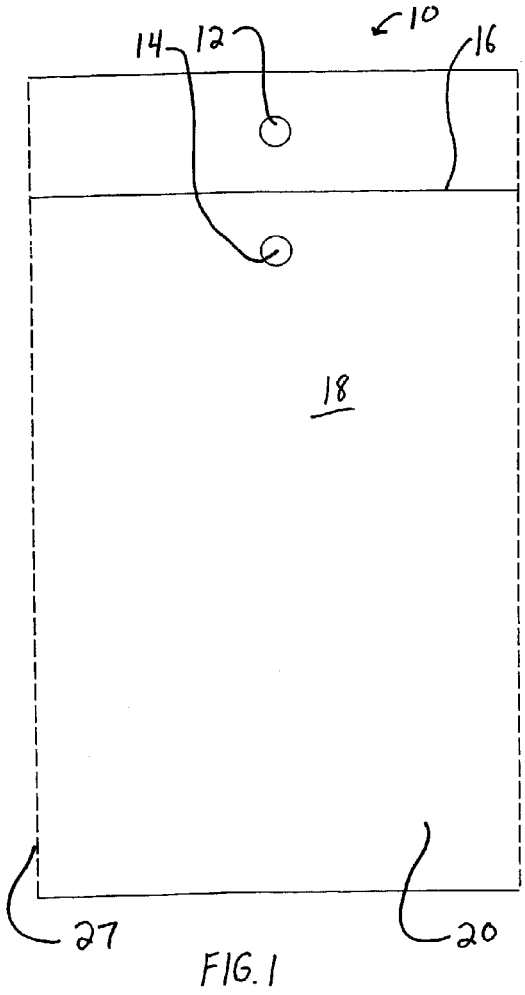
FIG. 1 is a plan view of the front of a form having a folding reinforcing portion according to one embodiment of the present invention.

While the invention is susceptible of embodiment in may different forms, there is shown in the drawings and will herein be described in detail preferred embodiments of the invention. It is to be understood that the present disclosure is to be considered as an exemplification of the principles of the invention. This disclosure is not intended to limit the broad aspect of the invention to the illustrated embodiments.

FIG. 1 shows a front view of a first embodiment of the present invention wherein the tag is generally indicated as reference numeral 10. The tag 10 includes a first opening 12 and a second opening 14. The openings are located equidistance from a fold line 16. The fold line 16 is generally a weakened line of material which allows the tag 10 to be easily folded in the desired location. The fold line 16 may be formed by scoring or perforating the tag during manufacture. The tag includes a first major surface 18 and a second major surface 19 of a tag material 20. It should be understood that the terms first, second, and the like are used interchangeably throughout this specification to describe surfaces, layers, or other structure, and should not be construed as identifying the same structure in each of the different embodiments disclosed or in the claims.

The materials used to manufacture this embodiment of the tag 10 generally include a tag material 20 of a relatively high durability and strength tag material. The material is preferably a synthetic material. The material has relatively high durability and strength in comparison to a paper tag material. Although, a paper material could be used in this embodiment, particularly if it is coated or otherwise treated to increase durability, strength, weatherability or other material characteristics. Some examples of materials which can be used in a tag according to the present embodiment include polyester, vinyl, nylon, Valeron, or Tyvek among others. The material is preferably printable, and may optionally include a coating to improve its strength, durability, weatherability, or its receptiveness to inks, among other things.

Figure 2:
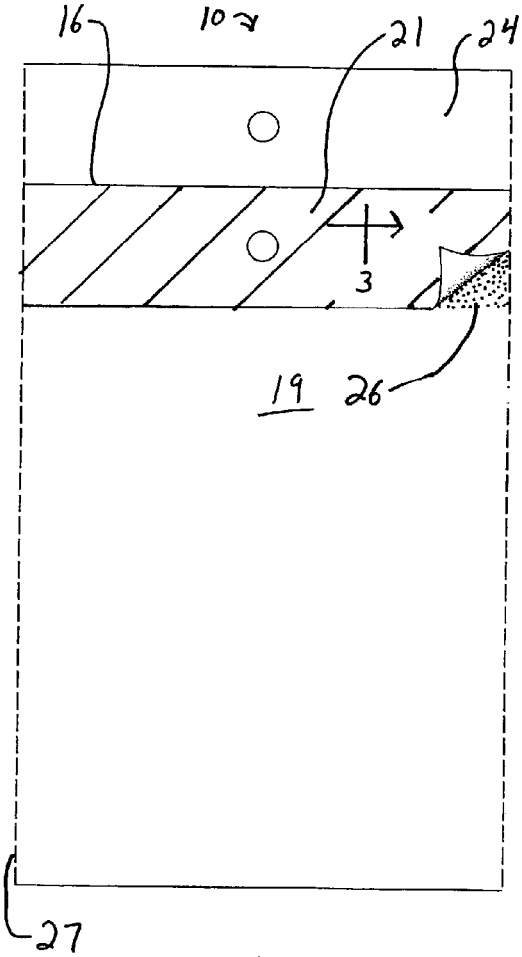
FIG. 2 is a plan view of the rear of the form of FIG. 1.
Figure 3:
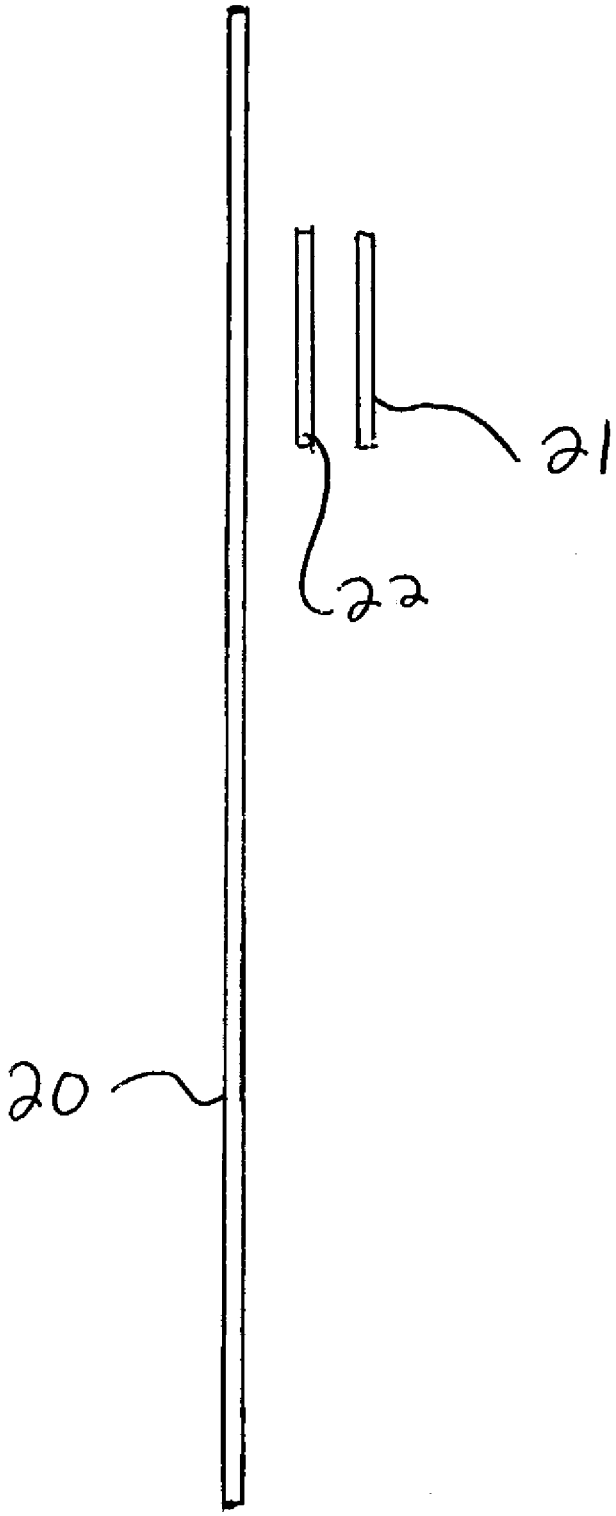
FIG. 3 is a cross-sectional exploded side view along line 3 of FIG. 2.

FIG. 2 depicts the rear of the tag of FIG. 1. The rear of the tag includes a release liner 21 bonded to the second major surface 19 of the tag material 20. A cross-sectional view of the tag along line 3 shows the various layers of the tag 10. It includes an adhesive 22 which bonds the release liner 21 to the second major surface 19 (FIG. 3). The release liner 21 is removably bonded to the tag material 20, and may be peeled away from the tag material 20, leaving the adhesive 22 on the second major surface 19.

Upon removal of the release liner 21, the adhesive 22 on the second major surface 19 of the tag material 20 is exposed. A user may then fold the tag 10 along the fold line 16 so a first portion 24, here located along an upper periphery of the front of the tag 10, becomes bonded to a second portion 26. In this embodiment, the adhesive 22 and release liner 21 are present only on the second portion 26. However, in other embodiments, the adhesive and release liner may cover the first portion 24, or both the first portion 24 and second portion 26 with the same beneficial results. When the tag 10 is placed in a folded position, the first opening 12 and second opening 14 become aligned and provide a continuous opening through the folded tag 10. The opening through the folded tag is reinforced in that it has double the thickness, or a double ply, of the relatively high durability and strength tag material 20. In use, a fastening member, such as a length of string, wire, or a plastic tie may be threaded through the opening and used to fasten or hang the tag 10, which functions as an identifying tag, preferably bearing printed indicia.

The tag 10 is preferably manufactured on a press wherein a web of the tag material 20 is in continuous movement through the press as an adhesive 22, release liner 21, and optionally a reinforcing material are applied. During the manufacture of a tag according to this embodiment, the release liner 21 may be continuously applied to a web of tag material 20 as it passes through the press. In this embodiment, the sides 27 of individual tags 10 are preferably perforated as they pass through the press. This allows them to be separated after what is generally a secondary printing operation is performed by an end user. A plurality of tags 10 are preferably left joined together by a weakened line of perforated material to allow for the continuous feeding of the tags 10 from a roll or fan-folded stack to a computer driven printer for customization of individual tags 10 by an end user.

Figure 4:
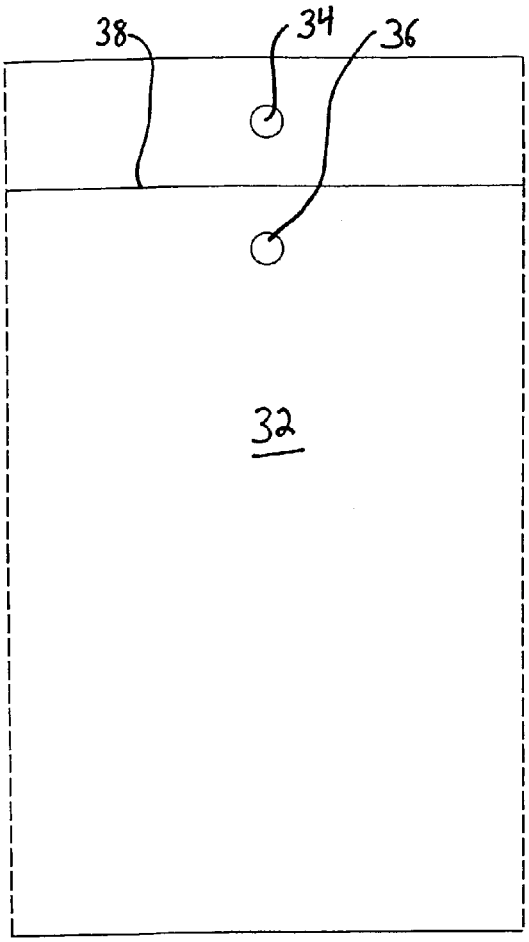
FIG. 4 is a plan view of the front of a form having a folding reinforcing patch according to another embodiment of the present invention.
Figure 5:
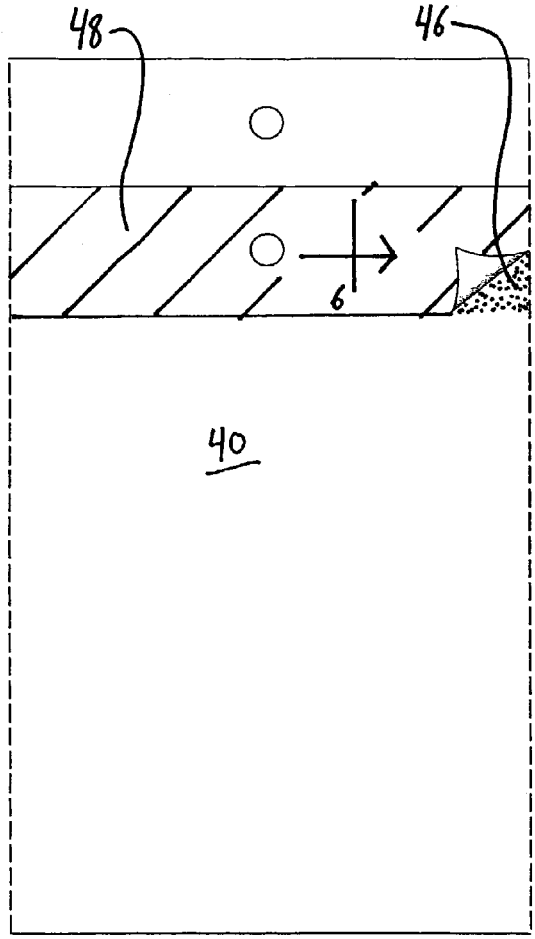
FIG. 5 is a plan view of the rear of the form of FIG. 4.
Figure 6:
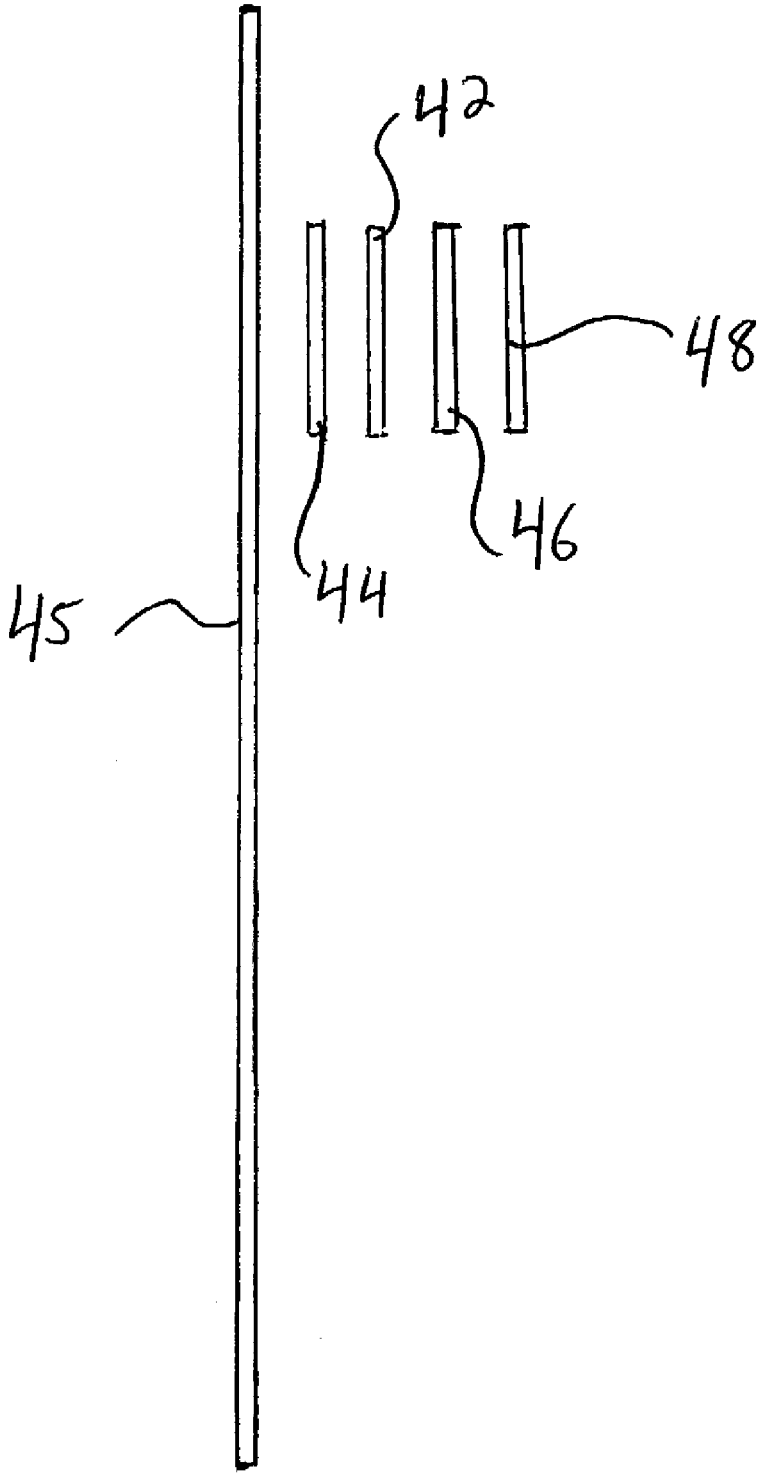
FIG. 6 is a cross-sectional exploded side view along line 6 of FIG. 5.

A second embodiment of a tag according to the present invention is generally depicted as reference numeral 30 in FIGS. 4–6. FIG. 4 shows a front view of the tag 30 including a first major surface 32. The tag includes a first opening 34 and a second opening 36. The openings are preferably circular holes, but the shape of the opening may be square, rectangular, non-geometric, or any other shape. It is, however, preferable that the first and second opening have shapes that are mirror images of one another such that when the tag 30 is folded along a fold line 38, the openings are aligned with one another and the perimeter of the opening is reinforced by the additional layers of material.

The rear of the tag 30 is shown in FIG. 5, and a cross-sectional view of the various layers of the tag 30 in FIG. 6 along line 6. The second major surface 40 of a tag material is permanently bonded to a reinforcing material 42 by a first adhesive layer 44. The reinforcing material 42 is preferably Valeron. Other suitable reinforcing materials may include paper, Mylar, Tyvek, nylon films, and numerous other plastic films. The preferred method of application of the reinforcing material is in the form of a two sided tape. Where a reinforcing material is used, a relatively low strength tag material may be used.

Bonded to the reinforcing material 42 on the side opposite to the second major surface 40 of the tag material 45 is a second adhesive layer 46. Removably bonded to the second adhesive layer 46 is a release liner 48. When the release liner 48 is peeled away from the second adhesive layer 46, as shown in FIG. 5, the second adhesive layer 46 remains bonded to the reinforcing material 42. The tag 30 may then be folded along the fold line 38. Folding the tag 30 along the fold line 38 aligns the first opening 34 and second opening 36 to form a single continuous opening through the tag 30, the periphery of which is reinforced, through which a fastening member may be threaded.

Figure 7:
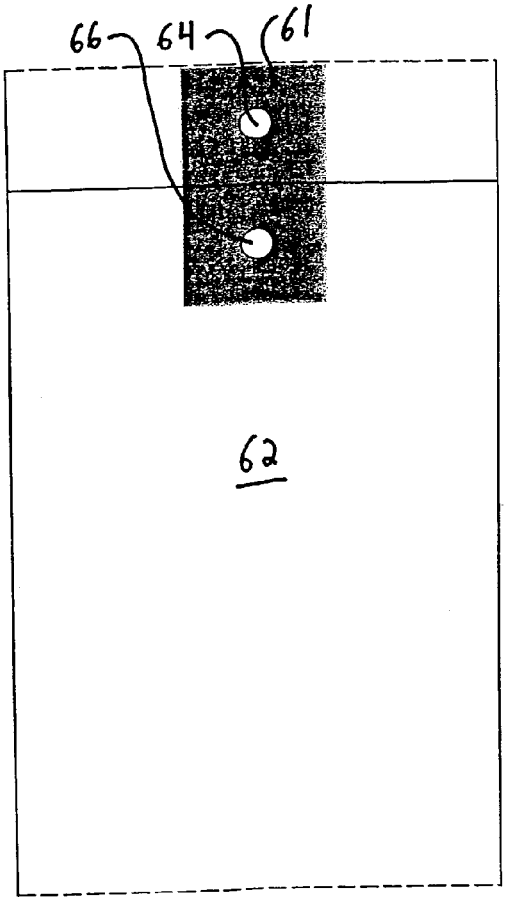
FIG. 7 is a plan view of the front of a form having a folding reinforcing patch bonded to the front of the form.
Figure 8:
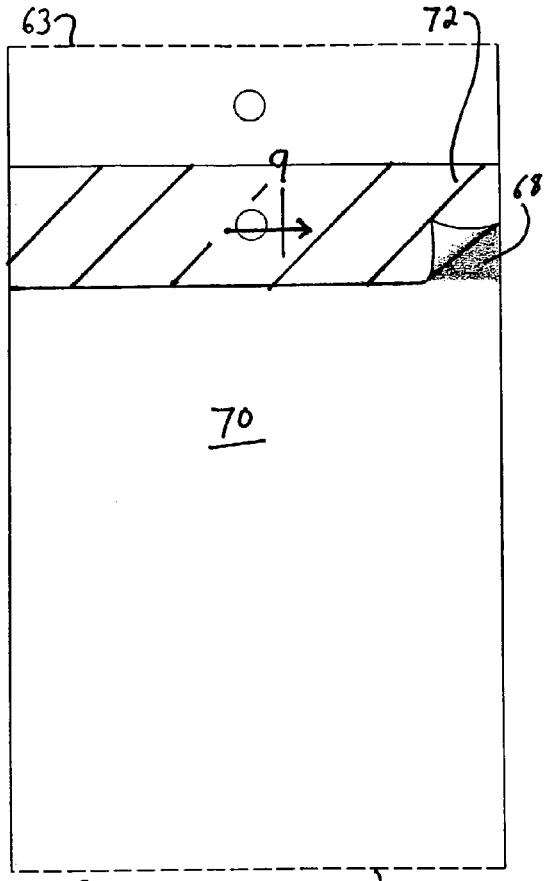
FIG. 8 is a plan view of the rear of the form of FIG. 7.
Figure 9:
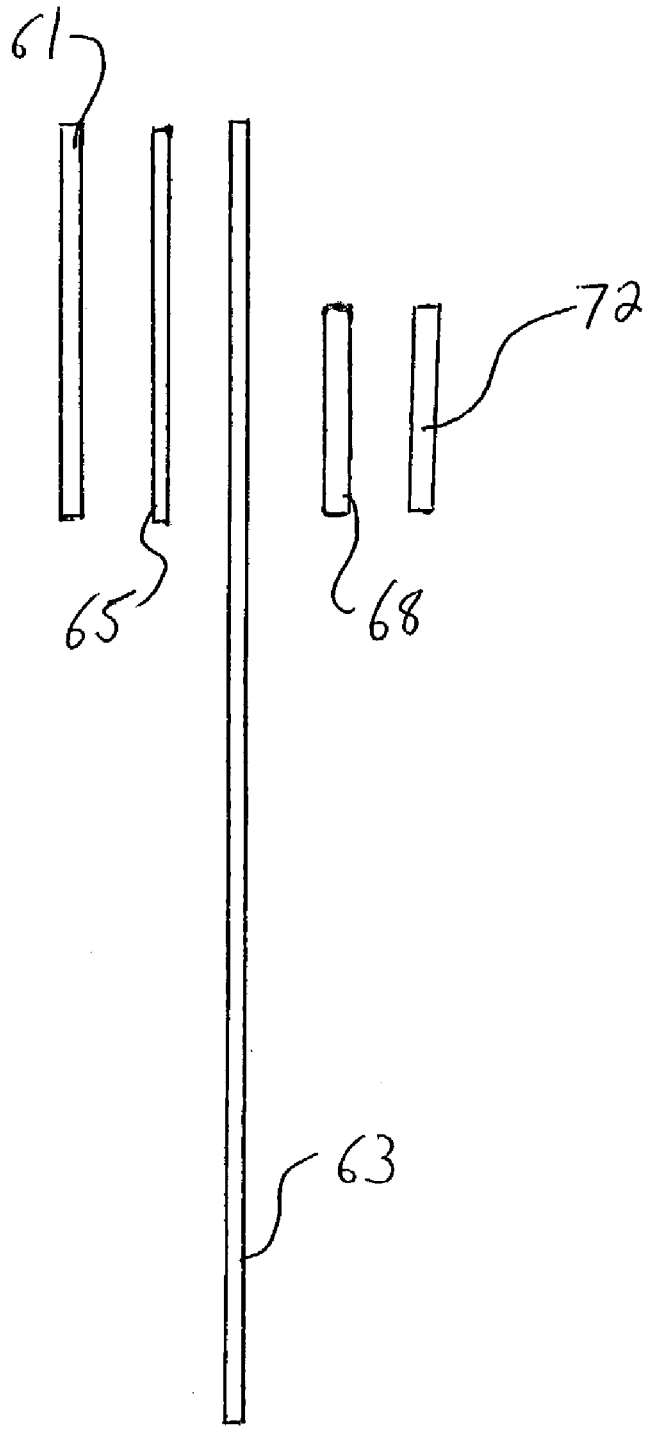
FIG. 9 is a cross-sectional exploded side view along line 9 of FIG. 8.

FIGS. 7–9 show another embodiment of a tag according to the principles of the present invention wherein the tag is generally shown by reference numeral 60. A front view of the tag is shown in FIG. 7. A reinforcing patch 61 is permanently bonded to a first major surface 62 of a tag material 63 by a first adhesive 65. The reinforcing patch 61 covers an extent of the first major surface 62 and includes a first opening 64 and a second opening 66 which extend through both the reinforcing patch 61 and the tag material 63. The reinforcing patch 61 is preferably as small as possible while providing the desired reinforcement for a particular use in order to reduce material costs. In this embodiment, a preferred reinforcing material is Valeron. This material provides adequate strength, yet is thin enough to allow a reinforced tag to pass through printers useful for the printing of individual tags prior to use.

The tag 60 of this embodiment is preferably manufactured on a press which allows for the continuous movement of a web of tag material 63 through the press, while the reinforcing patch 61, adhesive, and a release liner material 72 are applied intermittently. Individual tags 60 are preferably left joined to one another at the top 63 and bottom 65 by perforated lines. This allows the tags 60 to be fed to a printing apparatus for what is typically a secondary printing operation, the first preferably being done during manufacture, in a roll or fan-folded form. The reinforcing patch 61, adhesive, and release liner material 72 are optionally and preferably intermittently applied to the tag material 63 to save on material costs by minimizing the size of the reinforcing patch, and in other embodiments, also to minimize the adhesive and release liner used. The intermittent application of reinforcing material, adhesive, and release liner material to a continuously moving web of tag material additionally allows for the rapid manufacture of tags according to the principals of the present invention. Furthermore, the ability to run a plurality of tags joined at the top and bottom of the individual tags in a roll, fan-folded, or sheet form through a printing apparatus which uses a ribbon allows a greater amount of the ribbon to be used. For example, when a tag according to the present invention is run through a thermal transfer printer.

A rear view of the tag 60 is shown in FIG. 8, and a cross-sectional view of the layers which make up the tag 60 in FIG. 9, along line 9. A second adhesive 68 covers an extent of a second major surface 70 of the tag 60. The adhesive 68 may be a continuous layer, or it may be a patterned application of adhesive. The adhesive is substantially covered by a release liner layer 72. The openings formed in the reinforcing patch 61 and the tag material 63 preferably also extend through the release liner layer 72. In use, the release liner layer 72 is peeled from the adhesive 68, and the tag is folded along fold lin 74. When the tag 60 is in the folded position, the openings are aligned to form a continuous opening through the tag 60.

Figure 10:
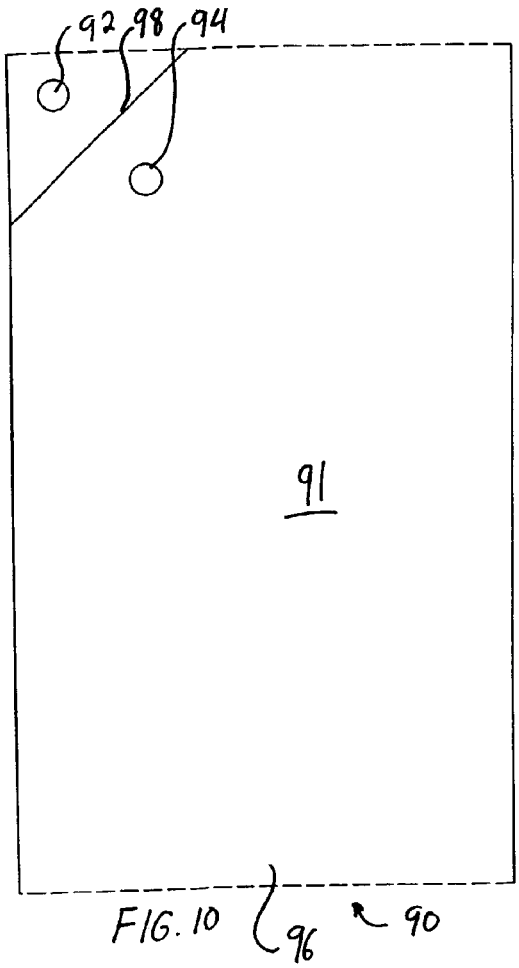
FIG. 10 is a plan view of the front of a form having a folding reinforcing portion according to another embodiment of the present invention.
Figure 11:
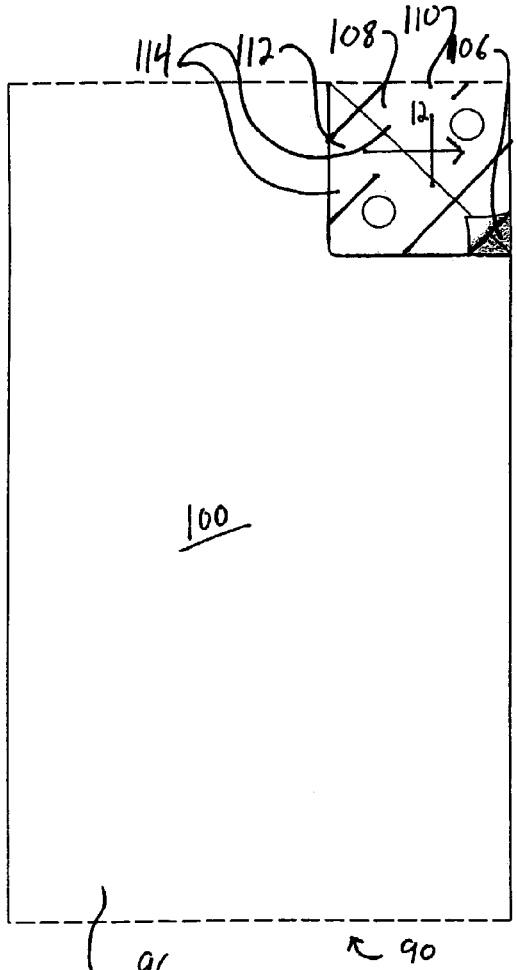
FIG. 11 is a plan view of the rear of the form of FIG. 10.
Figure 12:
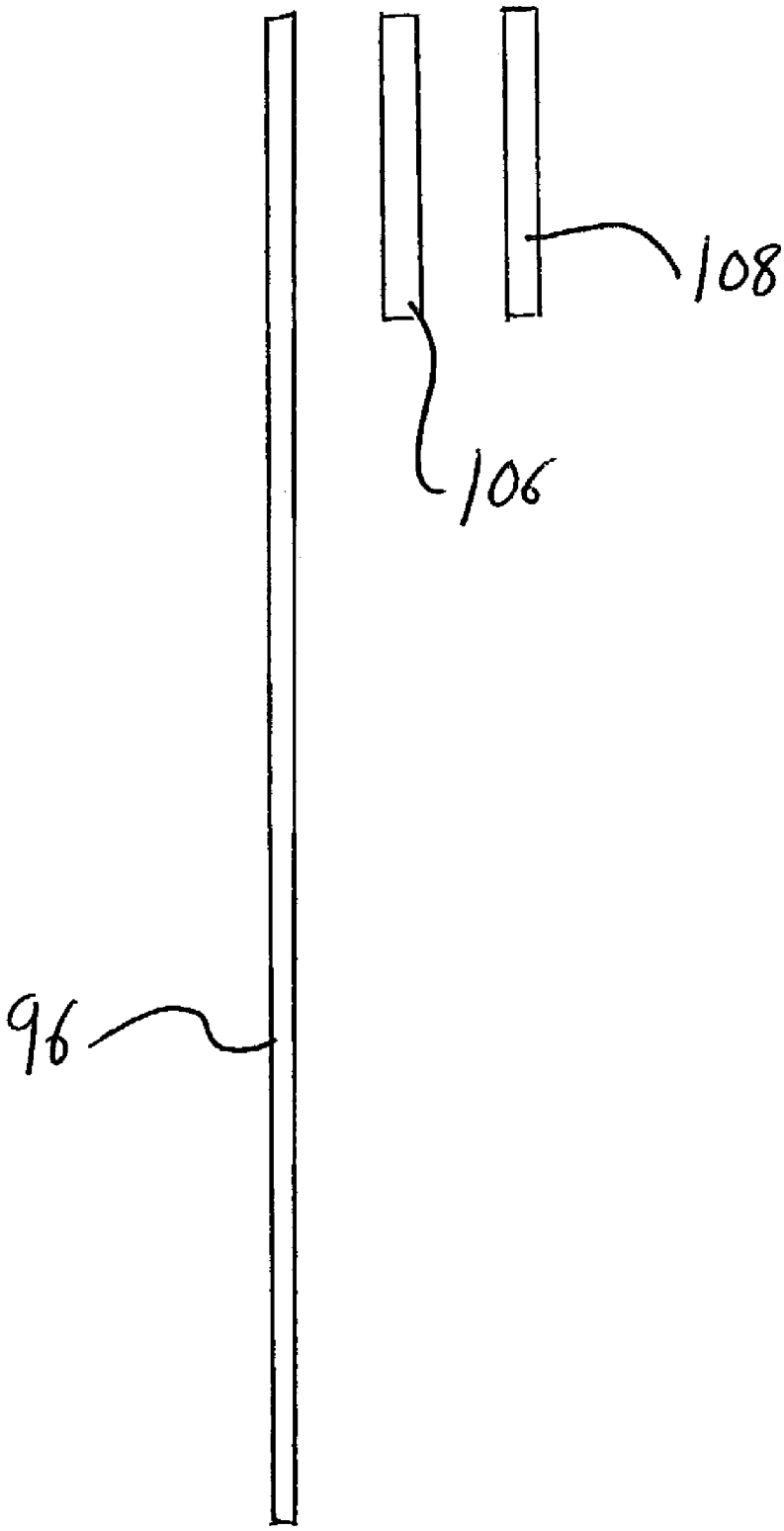
FIG. 12 is a cross-sectional exploded side view along line 12 of FIG. 11.

FIGS. 10–12 show another embodiment of a tag according to the principles of the present invention wherein the tag is generally shown as reference numeral 90. A front view of the tag 90 is shown in FIG. 10, and shows a first major surface 91 of the tag. A first opening 92 and second opening 94 are formed in the tag material 96. The location of the openings is preferably arranged such that when the tag is folded along a fold line 98 the openings become aligned.

FIG. 11 shows the rear of the tag 90. A second major surface 100 of the tag material 96 has adhesive 106 bonded to it. A removable release liner 108 substantially covers the adhesive 106. The adhesive 106 is preferably applied to the second major surface of the tag material 96 such that when the tag 90 is placed into the folded position after removal of the liner 108, substantially the entirety of a first folding portion 110 becomes securely bonded to a second portion 112 of a reinforcing region 114 comprising the first and second portions which become bonded to one another. In this embodiment, both the first and the second portions of the second major surface of the tag 90 are covered by an adhesive. Securely bonding substantially the entire first folding portion 110 to the second portion 112 is beneficial because it increases the bond area, and preferably prevents any corners present on the first folded portion 110 from peeling away from the second portion 112 during use of the tag 90.

The tag 10 of FIGS. 1–3 and the tag 90 of FIGS. 10–12 are generally rectangular in shape. However, tags in accordance with the present invention could be any shape. Likewise, the folding reinforcing portion of tags in accordance with the present invention could be many different shapes. FIG. 2 shows a tag 10 having a reinforcing region having a rectangular folding portion. FIG. 11 shows a tag 90 having a first folding portion 110 which is triangular in shape. Many other shapes could be used for either the tag itself, or the folding reinforcing portion of the tag, while retaining the beneficial aspects of the present invention.

Figure 13:
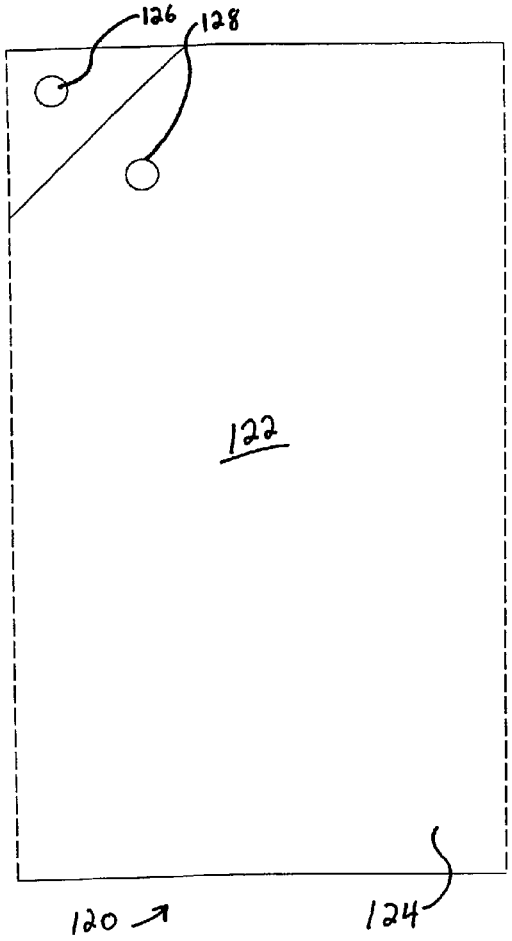
FIG. 13 is a plan view of the front of a form having a folding reinforcing portion according to another embodiment of the present invention.
Figure 14:
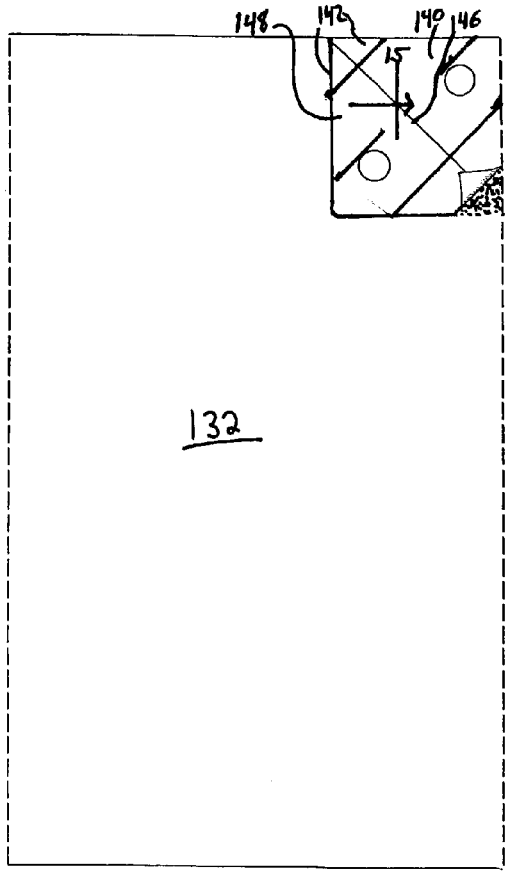
FIG. 14 is a plan view of the rear of the form of FIG. 13.
Figure 15:
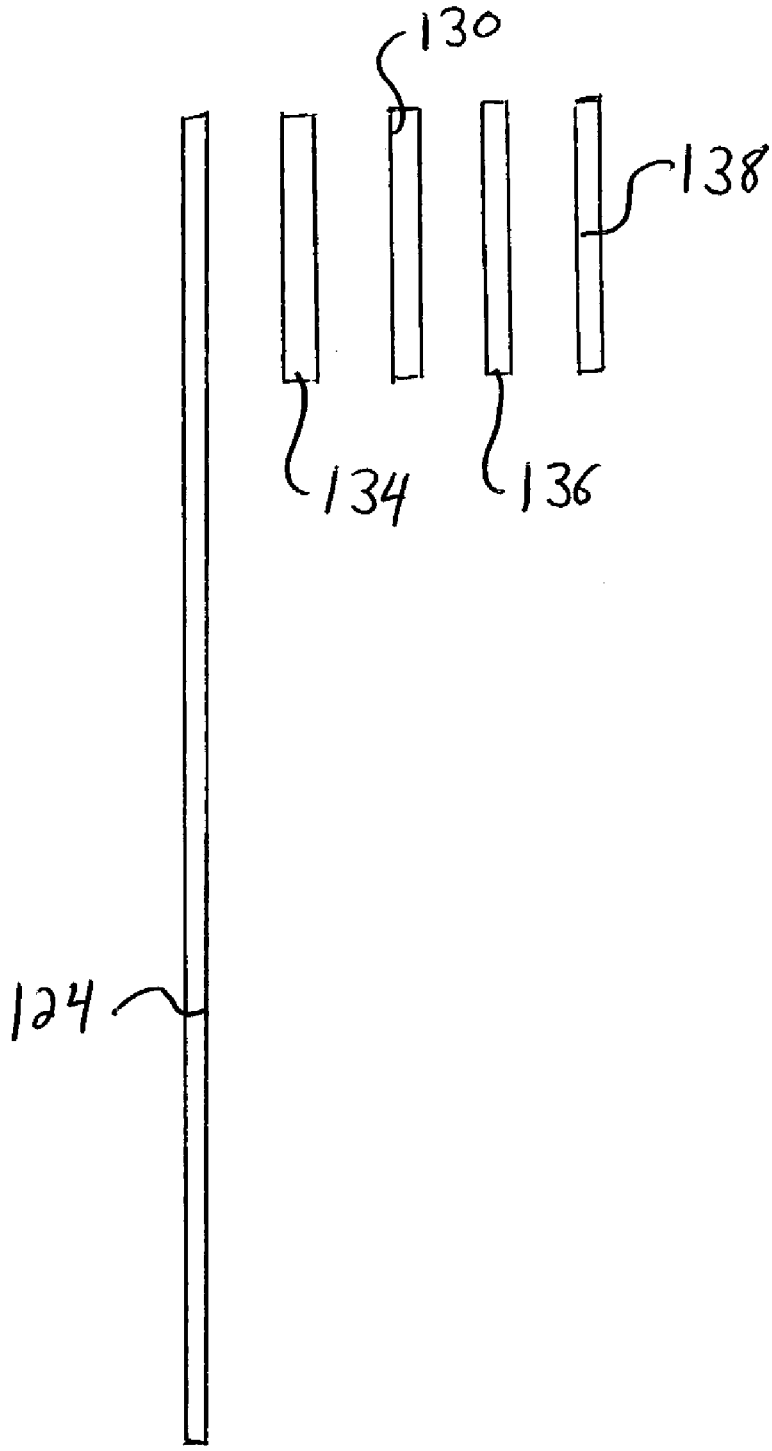
FIG. 15 is a cross-sectional exploded side view along line 15 of the form of FIG. 14.

FIGS. 13–15 show another embodiment according to the principles of the present invention wherein the tag is generally depicted by the reference numeral 120. FIG. 13 is a plan view of the front of the tag 120, and shows a first major surface 122 of the tag material 124. The tag 120 includes a first opening 126 and a second opening 128. FIG. 14 is a plan view of the rear of the tag 120 which includes a two-sided tape bonded to it. FIG. 15 is a cross-sectional view of the tag 120 along line 15. The two-sided tape includes a reinforcing patch 130 of a reinforcing material bonded to a second major surface 132 of the tag material 124 by a first adhesive layer 134. The two-sided tape further includes a second adhesive layer 136 bonded to the other side of the reinforcing patch 130. The second adhesive layer 136 is substantially covered by a layer of a release liner material 138. In use, the release liner material 138 is removed from the two-sided tape, and a first folding portion 140 of a reinforcing region 142, which has the two-sided tape on it, is folded along a fold line 146 and bonded to a second portion 148 of the reinforcing region 142 of the tag 120. The first opening 126 and second opening 128 become aligned, and a fastening member can be threaded through the continuous opening through the tag and reinforcing material in order to facilitate attaching the tag 120 to another object.

Figure 16:
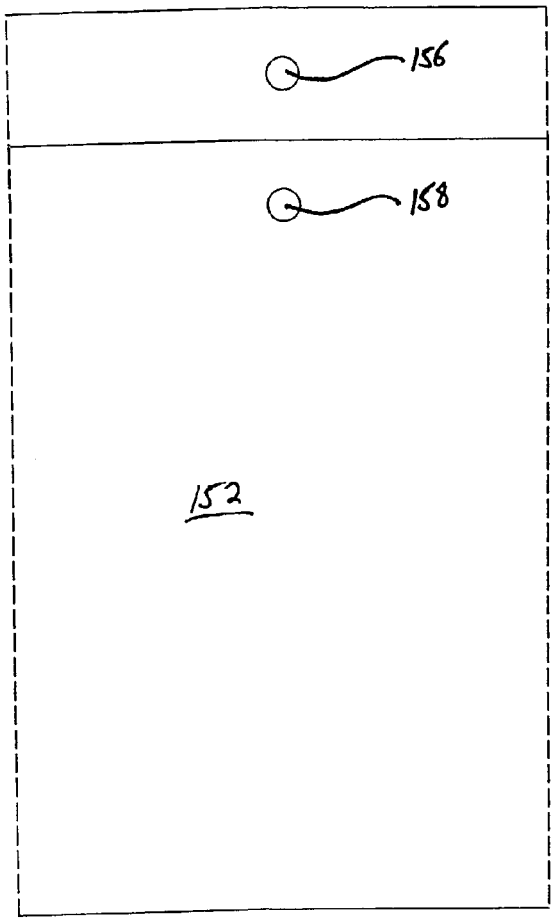
FIG. 16 is a plan view of the front of a form having a folding portion and a reinforcing portion according to another embodiment of the present invention.
Figure 17:
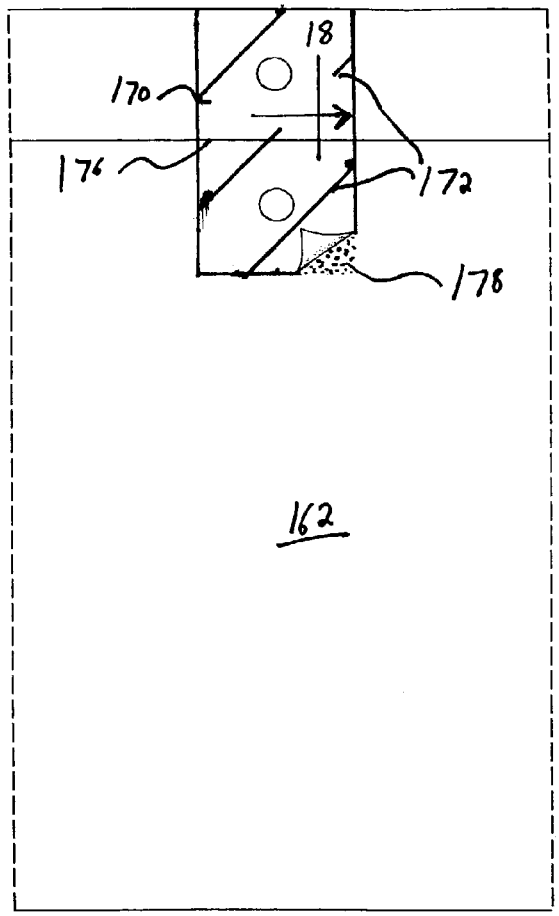
FIG. 17 is a plan view of the rear of the form of FIG. 16.
Figure 18:
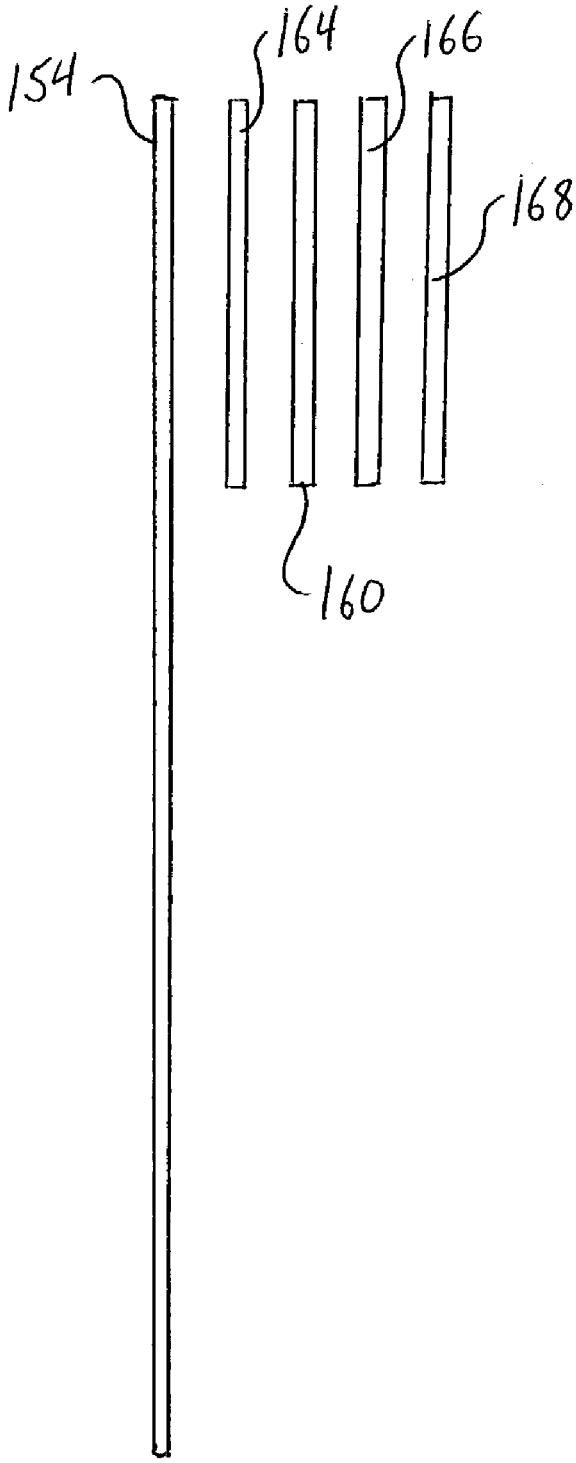
FIG. 18 is a cross-sectional exploded side view along line 18 of the form of FIG. 16.

In FIGS. 16–18 another example embodiment of a tag is shown by reference numeral 150. FIG. 16 is a plan view of the front of the tag 150, and shows a first major surface 152 of the tag material 154. The tag 150 includes a first opening 156 and a second opening 158. FIG. 17 is a plan view of the rear of the tag 150 which includes a two-sided tape bonded to it. FIG. 18 is a cross-sectional view of the tag 150 along line 18. The two-sided tape includes a reinforcing patch 160 of a reinforcing material bonded to a second major surface 162 of the tag material 154 by a first adhesive layer 164. The two-sided tape further includes a second adhesive layer 166 bonded to the other side of the reinforcing patch 160. The second adhesive layer 166 is substantially covered by a layer of a release liner material 168. In use, the release liner material 168 is removed from the two-sided tape, and a first folding portion 170 of a reinforcing region 172, which has the two-sided tape on it, is folded along a fold line 176 and bonded to a second portion 178 of the reinforcing region 172 of the tag 150.

The first opening 156 which extends through the reinforcing patch 160 and tag material 154 preferably also extends through the release liner 168. However, in other embodiments, the opening does not extend through the release liner. Because the release liner is preferably removed prior to use as a tag, this does not detract from the usefulness of the tag.

It may be desirable to use a press having printing capabilities during the manufacture of a tag to provide a tag with text or designs printed on its surfaces. In addition, it is desirable that the end user be able to print individual tags prior to use. A tag as described in the previously discussed embodiments may be printable using a variety of methods. A plurality of individual tags are preferably operably connected into multi-tag forms, generally sheets, continuous fan folds, or rolls. These forms allow a plurality of individual tags to be continuously fed through a printing apparatus, preferably a computer driven printing apparatus. In each of these instances, the individual tags are preferably separated by a perforation allowing the individual tags to be removed as needed. The tags may be easily adapted to be printed using many standard printing techniques. These may include the use of a thermal transfer printer, a laser printer, a pin-fed printer, a typewriter or other commonly used printing apparatus. It is most preferable that the tags be sized to operate with standard printers which are used widely. In the case of thermal transfer printers, it may be most beneficial to have labels which can be run through standard four (4) inch, six (6) inch, or eight (8) inch printers.

The use of certain printers may benefit from a pin feeding system including pin holes arranged along the sides of the tags. In that case, a tag according to the principles of the present invention could be modified accordingly during manufacture.

Figure 19:
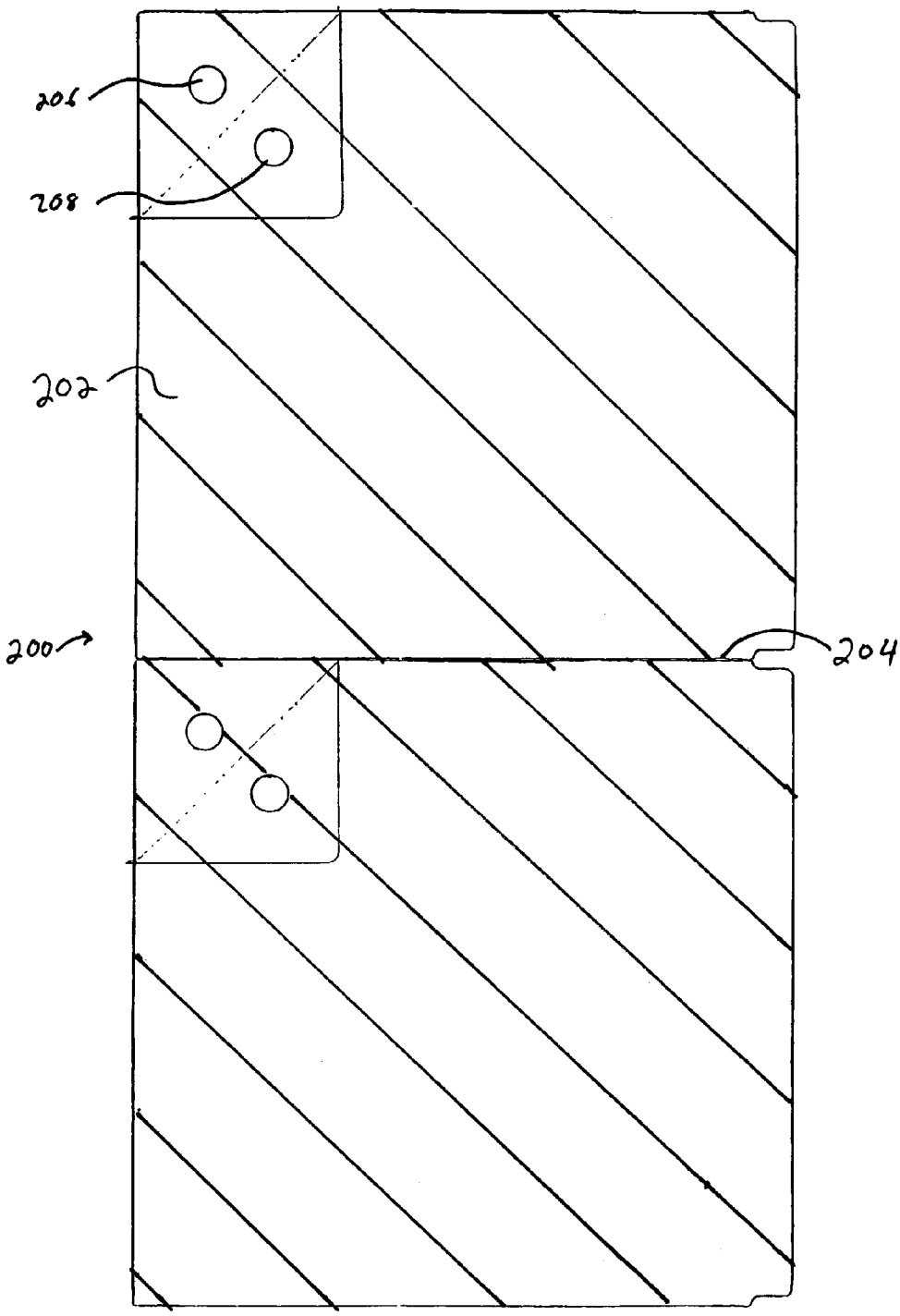
FIG. 19 is a plan view of the front of a form including a plurality of individual tags.
Figure 20:
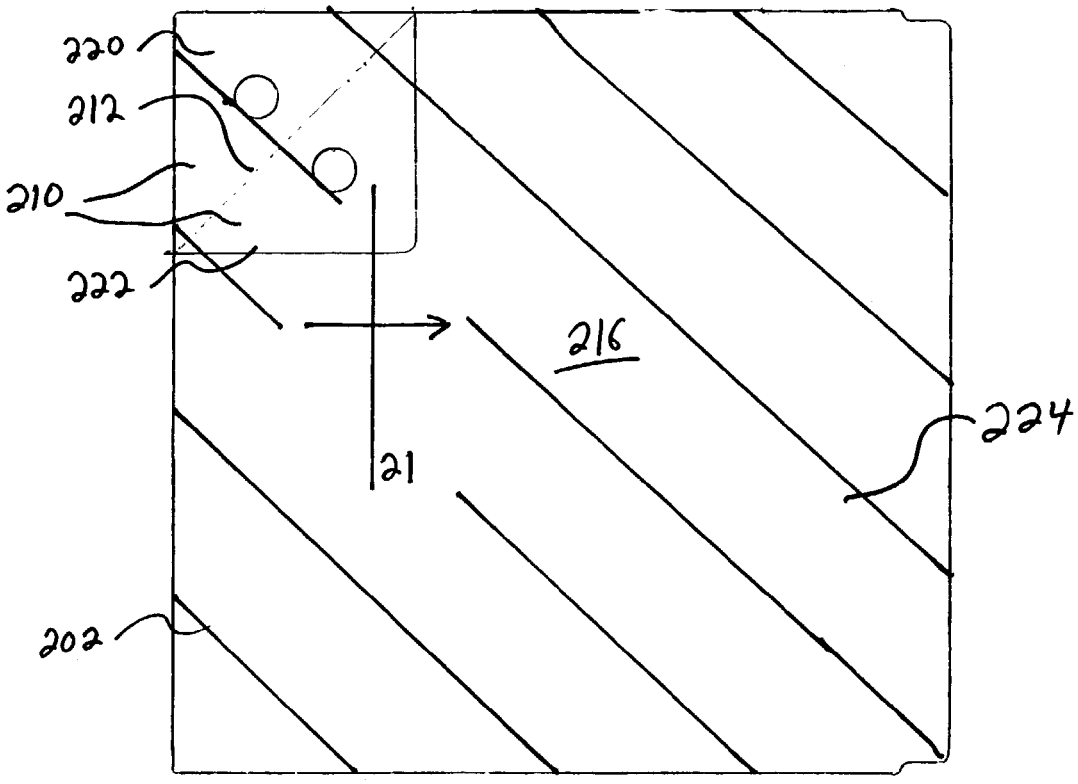
FIG. 20 is a plan view of an individual tag from the form of FIG. 19.
Figure 21:
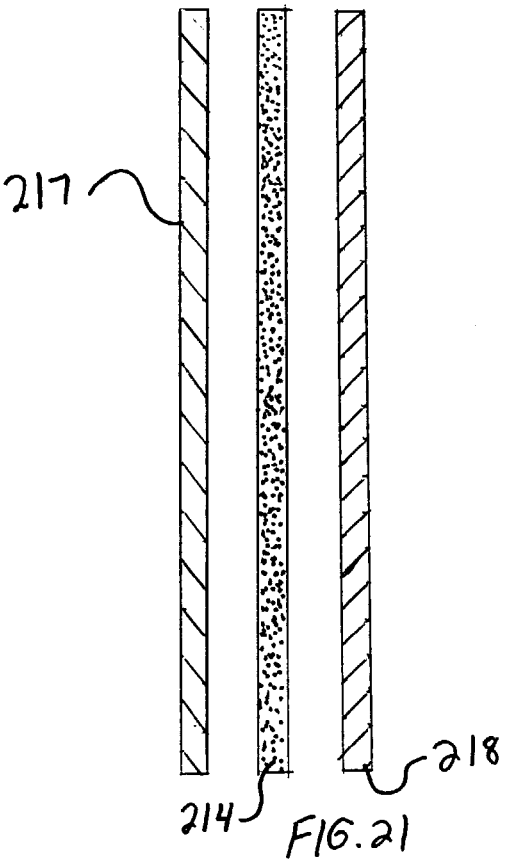
FIG. 21 is a cross-sectional exploded side view along line 21 of FIG. 20.

FIG. 19 shows a multi-tag form 200 having a plurality of two individual tags 202 arranged so they may be continuously fed into a printing apparatus, such as a standard four inch thermal transfer printer. The tags 202 are operably connected to one another by a weakened line of material 204, which is preferably scored or perforated. The individual tags each have a first opening 206 and a second opening 208. FIG. 20 shows an individual tag from the form of FIG. 19. The openings of the individual tag are formed in a reinforcing region 210. A fold line 212 separates the first opening 206 and second opening 208. FIG. 21 shows the various layers of the tag 202 of FIG. 20 in a cross-sectional view. The individual tags 202 of FIGS. 19–21 may function as either a tag or a label, and are in effect a tag/label hybrid. An adhesive 214 covers an entire major surface 216 of the tag material 217 in each of the individual tags 202. A release liner 218 covers the adhesive 214.

When it is preferred the form 200 function like a tag, the release liner covering the reinforcing region 210 is selectively removed from the form 200, exposing the adhesive covering just that portion. The liner is preferably die cut along the reinforcing region 210 so just the release liner material covering that portion may be removed, without disturbing the release liner covering the remainder of the adhesive on the first major surface. A first folding portion 220 is then folded along the fold line 212, and adhered to a second portion 222 of the reinforcing section 210. A fastening member may then be threaded through the reinforced opening.

When it is preferred the form 200 function as a label, the release liner covering the main body portion 224 of the form 200 is removed along with the portion of the release liner covering the reinforcing region 210. At that point, the adhesive covering the entire first major surface 216 is exposed, and the form may be adhered to an object in the same manner as a standard label.

Figure 22:
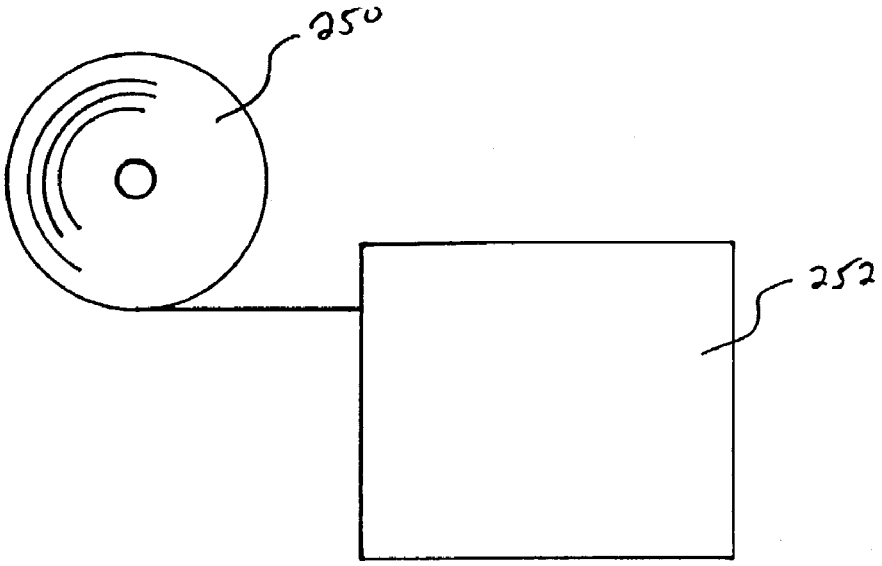
FIG. 22 is a side view of a form according to one embodiment of the present invention being fed to a printer during use.
Figure 23:
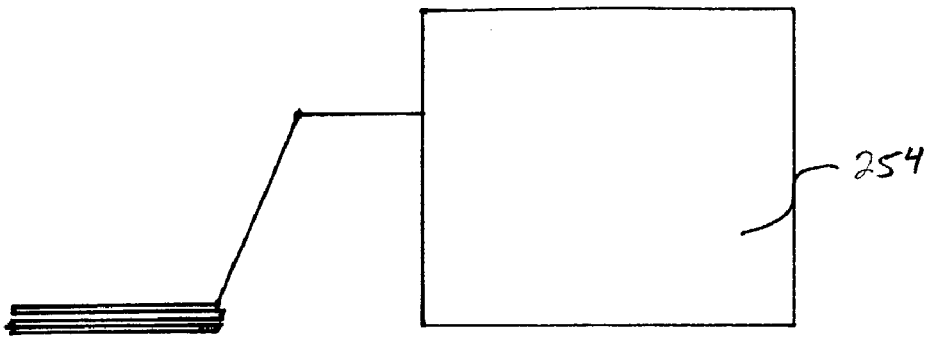
FIG. 23 is a side view of a form according to another embodiment of the present invention being fed to a printer during use.

FIG. 22 shows a roll 250 of tags made according to the principles of the present invention being fed in a continuous manner to a computer driven printer 252. The roll 250 is a form which facilitates loading a single feed to the printer 252, from which individual tags may be printed by a user as desired. In much the same manner, a continuous form may include a fan folded arrangement as shown in FIG. 23. A plurality of individual tags are operably connected allowing them to be continuously fed to a printer 254.

Figure 24:
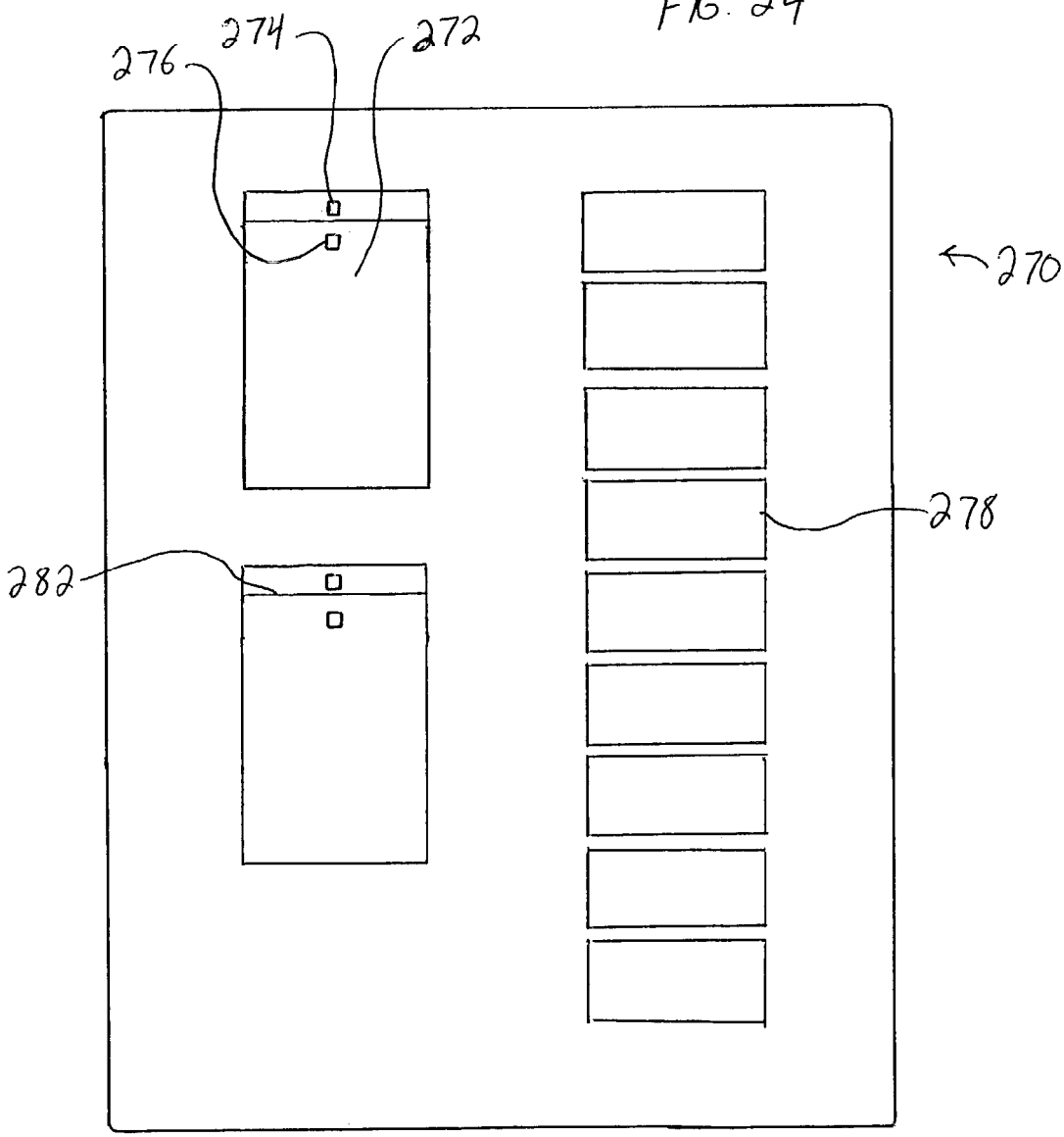
FIG. 24 is a front plan view of a form according to another embodiment of the present invention.
Figure 25:
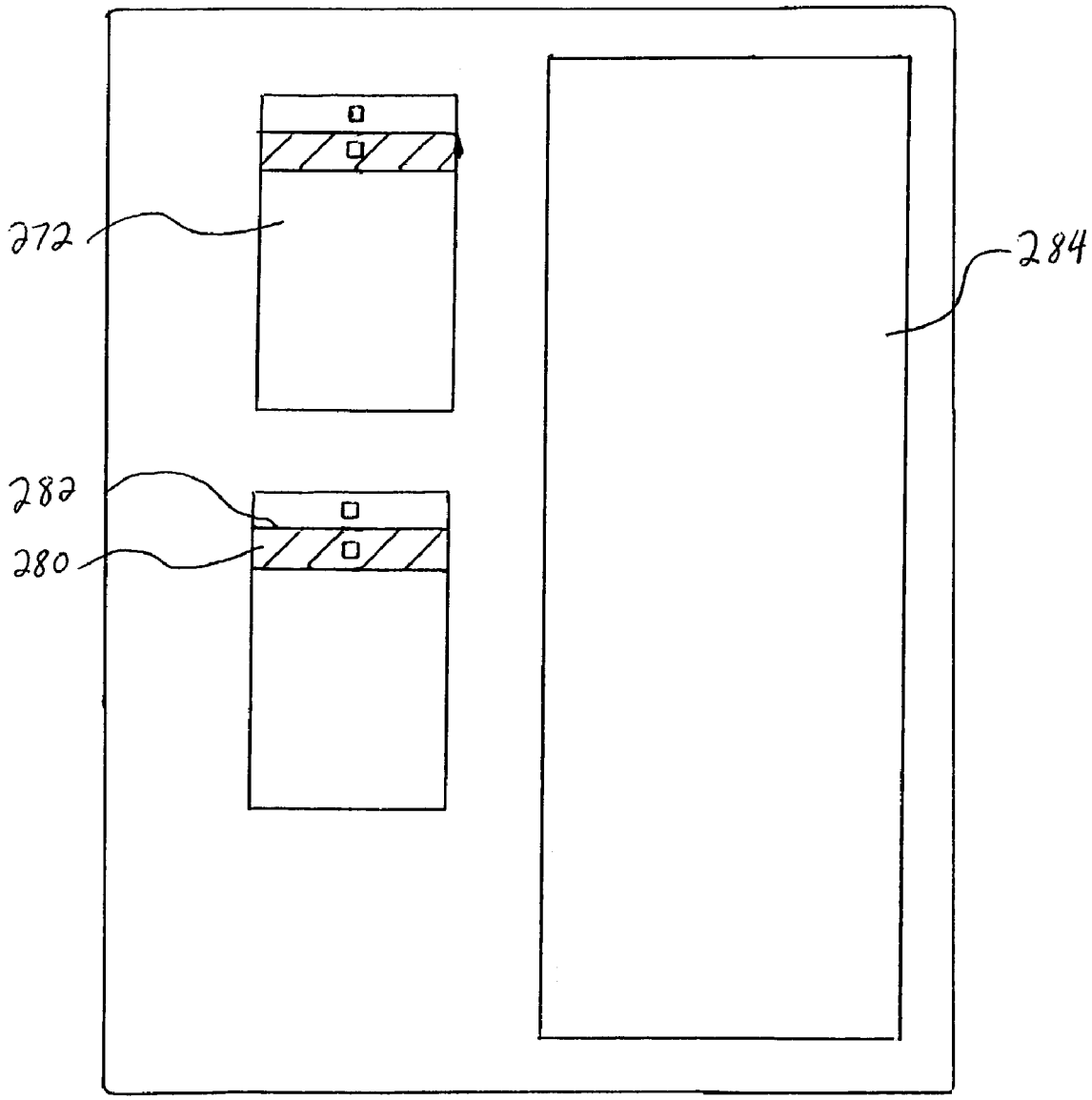
FIG. 25 is a rear plan view of the form of FIG. 24.

In another embodiment of the present invention disclosed in FIGS. 24 and 25, a sheet form 270 having tags 272 formed in it is shown. The sheet form 270 is preferably sized to fit in a laser printer, or other commonly used printer. For example, the sheet form 270 may be eight and one half inches by eleven inches.

The front of the sheet form 270 is shown in FIG. 24. Individual tags 272 are preferably seperable from the sheet form 270 due to perferations about the tag 272 perimeter. The tag 272 preferably includes a first opening 274 and a second opening 276. In the preferred embodiment, the openings are preformed. However, in other embodiments the openings may be formed by perforating the tag material for later removal by a user.

Labels 278 are optionally and preferably die cut into the front of the sheet form 270. The labels preferably have a pressure sensitive adhesive on the back surface. When the sheet form 270 is run through a printing apparatus during use, printed indicia is printed on the tags 272 and labels 278. The tag 272 may then be removed from the sheet form 270, and secured to an object using a fastening member. The labels 278 may also be removed from the sheet form 270 and adhered to another object as desired.

The back of the sheet form 270 is shown in FIG. 25. The back of the tags 272 include a removable liner material 280. Once the tag 272 has been separated from the sheet form 270, the liner material 280 may be removed exposing an adhesive (not shown). As previously discussed, the tag 272 may then be folded along a fold line 282 to align the two openings. The back of the form may also include a release liner material 284 to which the labels 278 are adhered.

One example application for the use of a sheet form 270 according to the present invention is in an automobile repair shop. When a customer brings a car in for repairs, their personal information is placed into a computer. A sheet form 270 is then printed using a standard laser printer. The personal information is printed onto each of the tags 272, and each of the labels 278. The tag 272 is then removed and secured to the persons automobile keys. A second tag 272 may optionally be attached to the automobile's rearview mirror. The sheet form 270 containing the remainder of the unused tags 272 or labels 278 may then be kept in a folder with billing or other information related to the customer. The labels 278 may be removed as desired and adhered to mailings to the customer, parts removed from the automobile, or other objects as desired. This is one example of the potential uses of such a sheet form 270. Numerous other uses immediately come to mind for which minor modifications to the tags or labels could be made to maximize efficiency, without departing from the spirit of the invention. While the specific embodiments have been illustrated and described, numerous modifications come to mind without significantly departing from the spirit of the invention, and the scope of protection is only limited by the scope of the accompanying claims.

I claim:

1. A plurality of tags each having a reinforcible opening, wherein the tags are operably connected to one another in a continuous manner such that the tags can be continuously fed into a printing apparatus, each individual tag comprising:

first and second major surfaces;

a first adhesive layer affixed to one of the first or second surfaces;

a liner material removably bonded to the adhesive layer;

wherein the tag includes two openings located equidistance from a fold line which divides the tag into a first portion and a second portion; and wherein when the liner material is removed from the adhesive layer and the tag is folded along the fold line into a folded position, the first portion and the second portion become bonded together such that the two openings are aligned and create a single opening through the folded tag.

2. The tag of claim 1 further comprising a reinforcing material bonded to the tag having at least one opening which is positioned such that when the tag is folded the opening is aligned with the two openings in the tag to form a single continuous opening through the tag.

3. The tag of claim 2 wherein the reinforcing material covers an extent of one of the first and second major surfaces of the tag and extents of both the first and second portions of the tag, and wherein the reinforcing material has two openings which are positioned such that when the tag is placed in the folded position the openings are aligned with the two openings in the tag to form a single continuous opening through the tag.

4. The tag of claim 2 wherein the reinforcing material is part of a two-sided tape adhered to the tag.

5. The tag of claim 2 wherein the adhesive layer is bonded to the first major surface and the reinforcing material is bonded to the second major surface.

6. The tag of claim 2 wherein the adhesive layer is bonded to the reinforcing material.

7. The tag of claim 1 wherein the plurality of reinforced tags is a roll of tags.

8. The tag of claim 1 wherein the plurality of reinforced tags are fan-folded.

9. The tag of claim 1 wherein the plurality of reinforced tags are formed on a single sheet.

10. The tag of claim 1 wherein the adhesive and liner cover substantially an entire extent of a major surface.

11. The tag of claim 10 wherein the liner is die cut such that a portion of the liner adjacent to the fold line may be selectively removed without disturbing a portion of the liner which covers a remainder of a major surface.

12. The tag of claim 1 wherein the fold line is a weakened line of a tag material.

13. A continuous feed multi-tag form for use in a continuously feedable printing apparatus comprising:

a plurality of operably connected tags, wherein each individual tag further comprises;

a reinforcing region having a fold line positioned between two openings such that when the tag is placed in a folded position by folding the tag along the fold line, the two openings become aligned such that they form a continuous opening through the tag; and wherein each tag further comprises an adhesive covered by a removable release liner material and arranged to bond the tag into the folded position when the removable release liner material is removed.

14. The continuous feed multi-tag form of claim 13 wherein each individual tag includes an area which is a printable surface.

15. The continuous feed multi-tag form of claim 13 further comprising a reinforcing material bonded to the individual tags and having at least one opening which is aligned with the two openings of the individual tags when the tag is in the folded position, and wherein when the tag is in the folded position the reinforcing material reinforces a perimeter of the aligned openings.

16. The continuous feed multi-tag form of claim 15 wherein the individual tags have a first major surface and a second major surface and wherein the reinforcing material is bonded to the first major surface, and the adhesive is bonded to the second major surface.

17. The continuous feed multi-tag form of claim 13 wherein the individual tags have a first major surface and a second major surface and wherein the reinforcing material is bonded to the first major surface, and the adhesive is bonded to a surface of the reinforcing material opposite the bond formed with the first major surface.

18. The continuous feed multi-tag form of claim 13 wherein the plurality of tags are a continuous roll of tags connected by a weakened line of material.

19. The continuous feed multi-tag form of claim 13 wherein the plurality of tags are fan folded and connected by a weakened line of material.

20. The continuous feed multi-tag form of claim 13 wherein the plurality of tags are formed in sheets which may be individually fed to the printing apparatus.

* * * * *